US011466420B2

(12) United States Patent
Stengl

(10) Patent No.: US 11,466,420 B2
(45) Date of Patent: Oct. 11, 2022

(54) FOUNDATION ENGINEERING MACHINE AND METHOD FOR PRODUCING A TRENCH IN THE GROUND

(71) Applicant: BAUER Maschinen GmbH, Schrobenhausen (DE)

(72) Inventor: Christian Stengl, Pörnbach (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 17/338,242

(22) Filed: Jun. 3, 2021

(65) Prior Publication Data

US 2021/0381191 A1 Dec. 9, 2021

(30) Foreign Application Priority Data

Jun. 4, 2020 (EP) ..... 20178379

(51) Int. Cl.

| | |
|---|---|
| ***E02D 17/13*** | (2006.01) |
| ***E02F 3/20*** | (2006.01) |
| ***E02D 5/18*** | (2006.01) |
| ***E02D 27/00*** | (2006.01) |
| ***E02F 3/18*** | (2006.01) |

(52) U.S. Cl.

CPC ..... *E02D 17/13* (2013.01); *E02D 5/187* (2013.01); *E02D 27/00* (2013.01); *E02F 3/188* (2013.01); *E02F 3/205* (2013.01); *E02D 2250/0023* (2013.01); *E02D 2300/002* (2013.01)

(58) Field of Classification Search

CPC ..... E02D 3/12; E02D 17/13; E02F 3/205

USPC ..... 405/267

See application file for complete search history.

(56) References Cited

U.S. PATENT DOCUMENTS 5,707,182 A * 1/1998 Leffer ..... E02F 3/47 405/266

8,632,275 B2 * 1/2014 Chagnot ..... E02D 7/16 173/39

(Continued)

FOREIGN PATENT DOCUMENTS

EP 1452645 A1 * 9/2004 ..... E02D 17/13

EP 1748110 A2 * 1/2007 ..... E02D 17/13

(Continued)

*Primary Examiner* — Frederick L Lagman

(74) *Attorney, Agent, or Firm* — Studebaker & Brackett PC

(57) ABSTRACT

A foundation engineering machine and method for producing a trench in the ground include a substantially vertical mast, a diaphragm wall apparatus displaceably supported in a longitudinal direction of the mast for producing the trench, and a bar-shaped holder, at the lower end of which the diaphragm wall apparatus is mounted and with which the diaphragm wall apparatus is linearly displaceable along the mast. An upper first clamping sledge with a first clamp for releasably clamping the bar-shaped holder and a lower second clamping sledge with a second clamp for releasably clamping the bar-shaped holder are movably supported on the mast. The first clamping sledge and the second clamping sledge are movable relative to each other, and the lower second clamping sledge has a connector for mounting an additional lifting device disposed on the ground, with which a force can be applied in the longitudinal direction onto the second sledge.

15 Claims, 5 Drawing Sheets

(56) References Cited

U.S. PATENT DOCUMENTS

| | | | | |
|---|---|---|---|---|
| 8,757,935 | B2 * | 6/2014 | Ditillo | E02D 5/46 173/184 |
| 10,113,288 | B2 * | 10/2018 | Steff De Verninac | E02D 15/04 |
| 2019/0323205 | A1 * | 10/2019 | Bernasinski | E02F 5/145 |

FOREIGN PATENT DOCUMENTS

| | | | | | |
|---|---|---|---|---|---|
| EP | 1 452 645 | B1 | | 9/2007 | |
| EP | 2 204 500 | A1 | | 7/2010 | |
| EP | 3 530 812 | A1 | | 8/2019 | |
| FR | 2 899 608 | A1 | | 10/2007 | |
| KR | 20090023818 | A | * | 3/2009 | E02D 17/13 |
| WO | WO-2005001210 | A1 | * | 1/2005 | E02D 17/13 |

* cited by examiner

FOUNDATION ENGINEERING MACHINE AND METHOD FOR PRODUCING A TRENCH IN THE GROUND

TECHNICAL FIELD

The invention relates to a foundation engineering machine having a substantially vertical mast, a diaphragm wall apparatus, which is displaceably supported in the longitudinal direction of the mast for producing a trench in the ground, and a bar-shaped holding means, at the lower end of which the diaphragm wall apparatus is mounted and with which the diaphragm wall apparatus is linearly displaceable along the mast.

The invention furthermore relates to a method for producing a trench in the ground with such a foundation engineering machine.

BACKGROUND

Diaphragm wall apparatuses having scaffold-like guide frames with guide plates are known that are suspended on a rope. With the guide frame such a diaphragm wall apparatus is able to guide itself in the formed trench. Due to the rope suspension very large trench depths can be reached without difficulty. However, such diaphragm wall apparatuses having a scaffold-like guide frame with guide plates are relatively large and therefore very laborious in terms of manufacturing, maintenance and when being transported.

From the generic EP 1 452 645 B1 a foundation engineering machine with a diaphragm wall apparatus can be taken which is designed as a diaphragm wall cutter without guide frame. The guidance of this compact cutter takes place by way of a bar-shaped holding means which is guided in a linearly displaceable manner in a guide sleeve on a mast of a carrier implement. Here, the bar-shaped holding means is suspended on a rope that is guided via the head of the mast. By means of a lifting winch on the carrier implement the rope can be actuated for lifting and lowering the bar-shaped holding means and thus the diaphragm wall apparatus.

Basically, in the case of such a foundation engineering machine a trench depth is limited to the length of the bar-shaped holding means which in turn depends on the length of the mast of the foundation engineering machine. During sinking an extension of the holding means can be carried out by installing additional bar elements. However, this increases the overall weight of the suspended load which is to be raised by the lifting means of the foundation engineering machine during an extraction from the ground. If, during the extraction, jamming of the diaphragm wall apparatus in the trench occurs, which is more likely to happen with an increasing trench depth, the maximum power and pull force of the foundation engineering machine can thereby be surpassed.

The pull force required for a possible recovery of a jammed diaphragm wall apparatus can be considerably higher than the pull force of the carrier implement that is necessary for the production of the diaphragm wall. Therefore, a carrier implement is frequently chosen that is overdimensioned for the actual production of the diaphragm wall. This carrier implement is more expensive and of greater weight than one adequately dimensioned for the mere diaphragm wall production and, in addition to the sheer equipment costs in terms of acquisition and operation, also causes an increased effort with regard to logistics. Consequently, there is the need for a solution that enables the use of a more economical carrier implement whilst still making it possible to recover the diaphragm wall apparatus in the event of its jamming.

SUMMARY

Disclosed is a foundation engineering machine and a method for producing a trench in the ground with a diaphragm wall apparatus, with which, while maintaining a compact overall size of the foundation engineering machine, trenches of greater depths can also be produced economically.

The foundation engineering machine according to the invention is characterized in that on the mast an upper first clamping sledge with a first clamping means for releasably clamping the bar-shaped holding means and a lower second clamping sledge with a second clamping means for releasably clamping the bar-shaped holding means are movably supported and the first clamping sledge and the second clamping sledge are movable relative to each other and in that the lower second clamping sledge is provided with a connecting means for mounting an additional lifting device which is arranged on the ground and with which a force can be applied in the longitudinal direction onto the second sledge.

A first aspect of the invention resides in the fact that for actuation and movement of the bar-shaped holding means two clamping sledges with clamping means are provided, by which the bar-shaped holding means can preferably be gripped alternately. Through the clamping means a releasable force-locked and/or form-locked connection can be established. Here, at least one of the clamping means can clamp the holding means at any chosen point. In this way, the bar-shaped holding means with the diaphragm wall apparatus mounted thereon can be displaced stepwise along the mast. The maximum length of a possible step corresponds thereby approximately to the length of the mast. Through this arrangement and procedure the use of bar elements that are considerably longer than the mast is preferably made possible. Alternatively, it is possible to mount almost any number of further bar elements for the extension of the bar-shaped holding means and to remove these again successively after sinking of the trench. In both cases relatively large trench depths can be realized that are greater than the length of the mast and can even amount to a multiple of the mast length.

According to a further aspect of the invention the lower second clamping sledge is provided with a connecting means for mounting an additional lifting device which is arranged on the ground and with which a force can be applied in the longitudinal direction onto the second sledge. If required, for instance in the case of a large trench depth and/or a jamming of the diaphragm wall apparatus in the trench, an additional lifting device can thus be mounted quickly and easily on the second clamping sledge. If the second clamping sledge, which is movably supported on the mast, is clamped tight an additional lifting force can thus be applied from the lifting device via the second clamping sledge in the longitudinal direction of the mast onto the bar-shaped holding means. As a result, the total pull force of the foundation engineering machine can be increased significantly. Due to the fact that in this process the lifting device can support itself directly on the ground this has no negative effect on the applied load of the mast or the tilt resistance of the foundation engineering machine. In fact, the latter can even be increased on account of a resultant counterforce.

A preferred embodiment of the invention resides in the fact that the first clamping means and the second clamping means can be actuated independently of each other by a control means for alternately clamping the bar-shaped holding means. Basically, the bar-shaped holding means can be clamped simultaneously by both clamping means and displaced through simultaneous movement of the at least two clamping sledges.

By preference, after a first sinking step the upper first clamping sledge can be released from the bar-shaped holding means and moved back upwards again while the bar-shaped holding means continues to be clamped and held by the passive lower second clamping sledge. After renewed clamping of the bar-shaped holding means by the upward-moved active first clamping sledge the clamping means of the second clamping sledge can be released. The second clamping sledge can remain in the lower position and the further feed step can solely take place through downward movement of the upper first clamping sledge. A stepwise extraction of the diaphragm wall apparatus with the first clamping sledge from the trench can take place in the reverse manner.

With the diaphragm wall apparatus a trench that typically is rectangular in cross-section can be produced in the ground, as is known for instance for forming a cut-off wall or a retaining wall. According to a further development of the invention it is preferred that the diaphragm wall apparatus is designed as a diaphragm wall cutter or as a diaphragm wall grab. In the case of a diaphragm wall cutter at least one pair of cutting wheels is provided which are rotationally driven about an axis of rotation directed transversely or orthogonally to the longitudinal or sinking direction. By preference, on the diaphragm wall cutter two cutting wheel pairs arranged parallel to each other are provided adjacently. In the case of a diaphragm wall grab two grab shovels are supported on the lower frame of the diaphragm wall apparatus.

A frame of the diaphragm wall apparatus is preferably designed without a guide frame with plate-shaped guide elements for resting against the walls of the trench. Preferably, the bar-shaped holding means is designed as a guide bar, by which the diaphragm wall apparatus can be guided from outside the trench. In particular, a cutter can be designed as a so-called CSM®-cutter which is guided from outside the trench.

Here, the holding means can basically be a single continuous guide bar. According to a further development of the invention it is especially preferred that the holding means is of greater length than the mast or formed with several bar elements. These bar elements are releasably connected to each other and can in particular be joined together stepwise during sinking. Accordingly, on extraction of the diaphragm wall apparatus the individual bar elements can be released again stepwise accordingly. By preference, the bar elements have a length that corresponds approximately to the length of the mast of the foundation engineering machine. The holding means can also be a single bar that projects beyond the length of the mast.

A particularly expedient embodiment variant of the foundation engineering machine according to the invention resides in the fact that the bar-shaped holding means is of tubular design. Inside the tube interior data and energy lines can be laid, e.g. for supplying hydraulic fluid and/or electricity. In addition, one or several conveying lines can be provided for supplying suspension to and/or discharging it from the diaphragm wall apparatus. In particular, the diaphragm wall apparatus can be provided for an in-situ method, wherein through supply of a hardenable suspension to the rotating cutting wheels a hardenable mass is produced in-situ together with the cut-off ground material. Through the holding means the diaphragm wall apparatus can be guided linearly along the mast.

According to a further embodiment variant of the invention it is advantageous if at least the upper first clamping sledge is movably driven along the mast. For this, the sledge is displaceably guided on a linear guide along the mast. As linear drive for example a double-acting hydraulic cylinder or a rope winch arrangement can be provided on the mast. Preferably, only the upper first clamping sledge is driven in a linearly movable manner while the lower second clamping sledge is merely supported in a displaceable manner on the mast without a linear drive of its own. Basically, it is also possible for both clamping sledges to be provided with a linear drive of their own on the mast. Moreover, three or more clamping sledges can also be provided on the mast.

The connecting means can be designed in any suitable way that allows a desired force transmission. Provision can be made for abutment surfaces, ball scrapers, screw connections or the like. An advantageous embodiment of the invention resides in the fact that the connecting means has at least one connecting lug directed transversely to the longitudinal direction, wherein for the releasable connection between a lifting cylinder of the lifting device and the second clamping sledge a locking bolt can be inserted through a fixing eyelet of the lifting cylinder and the at least one connecting lug. Hence, through the connecting means a stable and easily releasable connection between the second clamping sledge and the lifting device can be achieved in a simple way. Preferably, for each fixing eyelet on a lifting cylinder of the lifting device two connecting lugs are in each case arranged laterally so that a good force transmission can take place from the lifting device to the second clamping sledge. The lifting force of the lifting device can in particular be applied during an extraction of the diaphragm wall apparatus, in which case the lifting force is directed upwards in the longitudinal direction of the mast.

Basically, a lifting force can, however, also be applied in the downward direction, for example if an additional feed force should become necessary when an obstacle is encountered. In this case, the lifting device can be additionally anchored to the ground.

The invention furthermore comprises a lifting device, in particular for the previously described foundation engineering machine according to the invention, wherein the lifting device is characterized in that it has a lower positioning frame for positioning on the ground and at least one lifting cylinder which is on the one hand fixed on the positioning frame and is on the other hand provided with a connecting element for connection to a clamping sledge. In particular, the lifting device can be releasably mounted in an easy way on the second clamping sledge of the previously described foundation engineering machine.

The lifting device according to the invention therefore constitutes an independent component which does not necessarily have to be assigned to a single foundation engineering machine. In fact, the lifting device can be held available as a standby component on a construction site with several foundation engineering machines having a diaphragm wall apparatus so that the lifting device is mounted on a specific foundation engineering machine only if need be for a limited period of time.

In particular, a need can arise if a diaphragm wall apparatus gets stuck in a trench filled with settable suspension, for example because the diaphragm wall apparatus is jammed in the trench or a power failure or power reduction of the present pulling device has occurred on a foundation engineering machine. Through quick mounting of the lifting device according to the invention the diaphragm wall apparatus can in such a case be extracted safely and reliably from the trench. In this way, it is possible to prevent an expensive diaphragm wall apparatus from being encased in concrete in a trench during setting of the suspension mass and thereby being lost or only being able to be freed again with considerable effort.

According to a further development of the invention it is especially preferred that two or more lifting cylinders are arranged which are preferably designed as hydraulic cylinders. For this, in particular, the lifting cylinders are evenly distributed over the positioning frame so that sufficient lifting forces that are as symmetrically as possible can be transmitted to a mounted clamping sledge. By making use of hydraulic cylinders particularly high forces can be generated. A lifting step can be repeated as often as required by releasing the second clamping means and resetting the second clamping sledge by the at least one lifting cylinder.

Furthermore, it is especially preferred that the positioning frame is of ring-shaped or partially ring-shaped design with a central passage for a bar-shaped holding means. The positioning frame can thereby be arranged in a bridge-like manner over a trench which is usually provided with concreted guide walls on the upper edge. By way of the positioning frame an even pressure can thus be applied symmetrically around the bar-shaped holding means onto a clamping sledge without this giving rise to high jamming forces along the guide of the mast, on which the clamping sledge is supported.

The method according to the invention for producing a trench in the ground with a foundation engineering machine is characterized in that by means of the bar-shaped holding means the diaphragm wall apparatus is sunk into the ground while ground material is being removed, wherein the trench is produced, in that by way of at least one of the clamping sledges the bar-shaped holding means is moved along the mast, in that the lower second clamping sledge is releasably connected to an additional lifting device which is positioned on the ground, and in that by means of the second clamping means the second clamping sledge is clamped tight on the holding means and by way of the additional lifting device a lifting force is applied to the holding means and the diaphragm wall apparatus. The method can in particular be carried out with the previously described foundation engineering machine according to the invention and accordingly with the previously described lifting device according to the invention.

The advantages described beforehand can be achieved thereby.

According to the invention a preferred method variant resides in the fact that during sinking at least one further bar element is installed on the bar-shaped holding means for extension. As a result, almost any trench depths can be achieved. At least during the extraction of the holding means thus extended the additional lifting device can be provided and is made use of it. Thus, relatively large trench depths can also be achieved with conventional carrier implements that have a limited pull force because for the application of an increased pull force during the extraction of the diaphragm wall apparatus with the extended holding means it is by way of the additional lifting device that the required lifting force can be applied in the upward direction. Hence, even for large trench depths cost-efficient, simple foundation engineering machines can be employed which can be equipped and retrofitted with the additional lifting device as needed.

According to a further method variant of the invention it is especially preferred that the trench is filled with a hardenable mass to form a diaphragm wall segment in the ground. In particular, a plurality of individual trenches can be formed next to each other so that, all in all, after filling and hardening of the mass a diaphragm wall can be produced in the ground. The diaphragm wall can be produced as a cut-off wall to prevent the ingress of ground water or as a retaining wall to secure an excavation pit. The filling of the hardenable mass can take place as early as during the production of the trench or in a so-called two-phase method only after production of the trench.

It is particularly preferred that the hardenable mass is formed in-situ in the trench during cutting.

Basically, by way of the additional lifting device an additional lifting or feed force can be applied as early as during sinking from the lifting device onto the bar-shaped holding means and thus onto the diaphragm wall apparatus. According to a further development of the invention it is especially preferred that the lifting force is applied by the lifting device during the extraction of the diaphragm wall apparatus from the ground. This can take place according to plan for example in the case of a significantly extended and therefore considerably heavier bar-shaped holding means or only when required for example if the diaphragm wall apparatus is unexpectedly stuck in the trench and the pull force present on the foundation engineering machine is by itself no longer sufficient.

BRIEF DESCRIPTION OF THE DRAWINGS

The invention is described further hereinafter by way of a preferred exemplary embodiment illustrated schematically in the drawings, wherein show.

DETAILED DESCRIPTION

Figure 1:
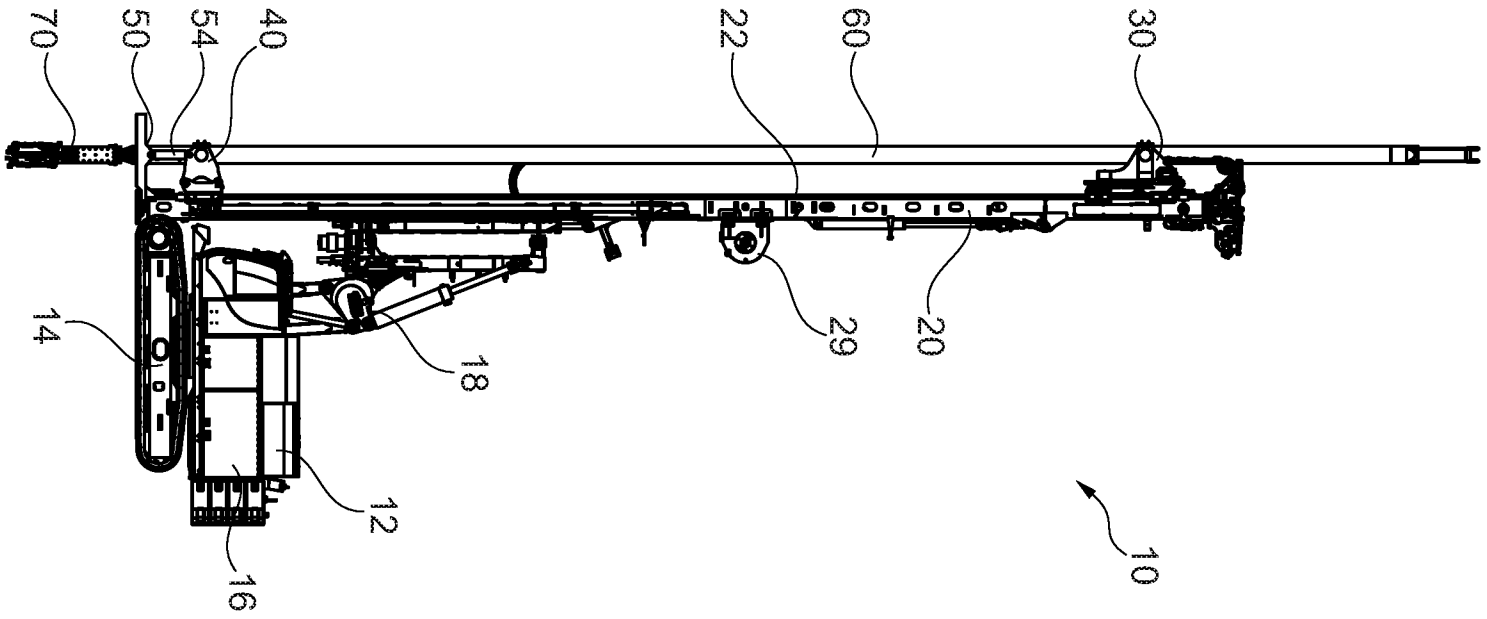
FIG. 1 a side view of a foundation engineering machine according to the invention.
Figure 2:
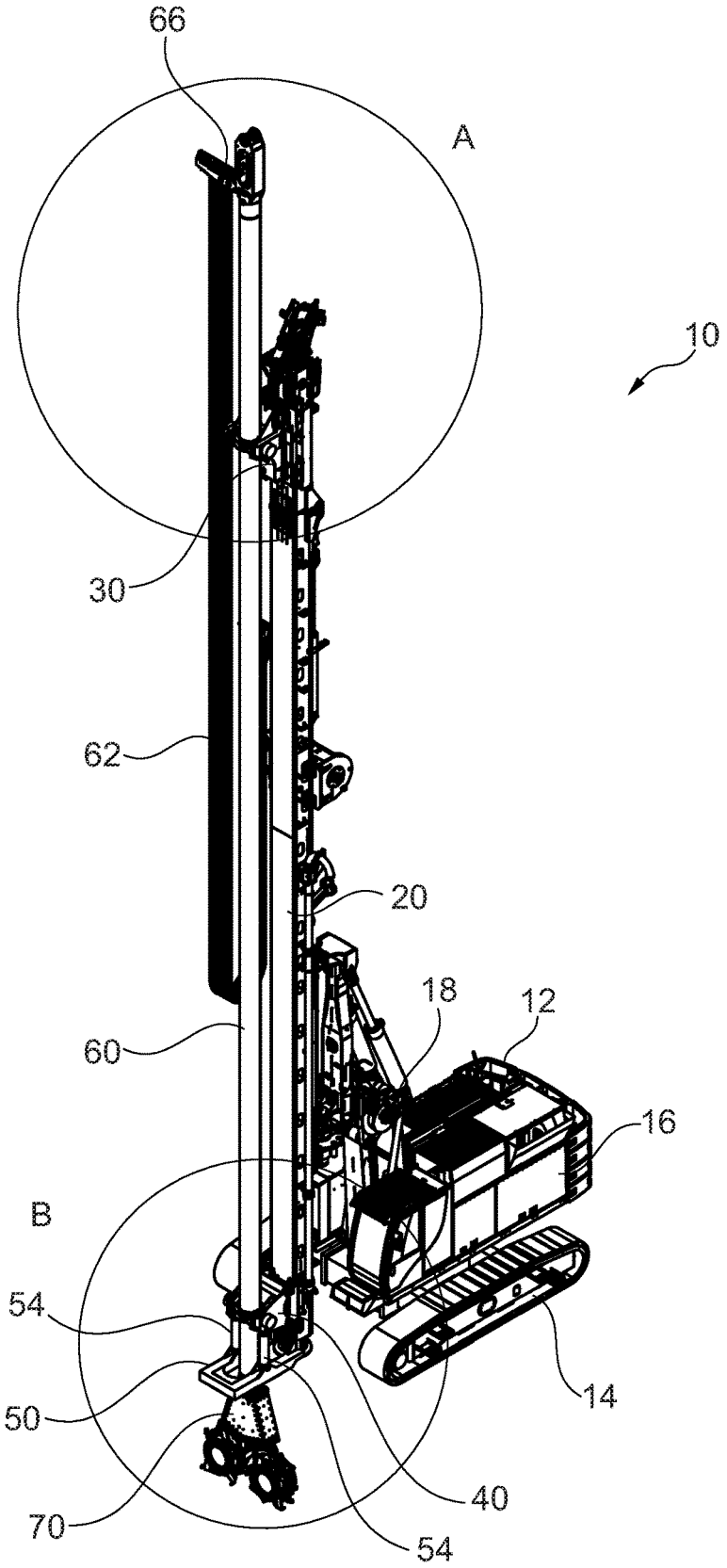
FIG. 2 a perspective view of the foundation engineering machine according to the invention of FIG. 1.

According to FIGS. 1 and 2 a foundation engineering machine 10 pursuant to the invention comprises a carrier implement 12 with a crawler-track running gear 14, on which an upper carriage 16 is supported in a rotatable manner. By way of an adjustment mechanism 18 with setting cylinders a mast 20 which in operation is substantially vertical is pivotably linked to the upper carriage 16 of the carrier implement 12.

Along a linear mast guide 22 on the front side of the mast 20 an upper first clamping sledge 30 and a lower second clamping sledge 40 are displaceably supported in a longitudinal direction of the mast 20. By way of the first clamping sledge 30 and the second clamping sledge 40 a bar-shaped holding means 60 is held and guided parallel to the mast 20. The structure and function of the first clamping sledge 30 and the second clamping sledge 40 will be explained in greater detail hereinafter in conjunction with FIGS. 3 and 4.

At the lower end of the mast 20 an additional lifting device 50 with lifting cylinders 54 is arranged which will be explained in greater detail hereinafter in conjunction with FIGS. 4 and 5.

At a lower end of the bar-shaped holding means 60 a diaphragm wall apparatus 70 designed as a diaphragm wall cutter is mounted. By way of the holding means 60 the diaphragm wall apparatus 70 can be sunk substantially vertically into a ground while a trench is being formed. By way of lines 62 that are connected on the one hand via the mast 20 to the carrier implement 12 and on the other hand to an attachment section 66 at the upper end of the bar-shaped holding means 60 energy and data connections are established between the carrier implement 12 and the diaphragm wall apparatus 70. Here, the lines 62 run from the attachment section 66 at the upper end of the holding means 60 via an inner hollow space of the tubular holding means 60 to the diaphragm wall apparatus 70. The lines 62 are arranged along the mast 20 and the holding means 60 in the manner of a cable track.

Figure 3:
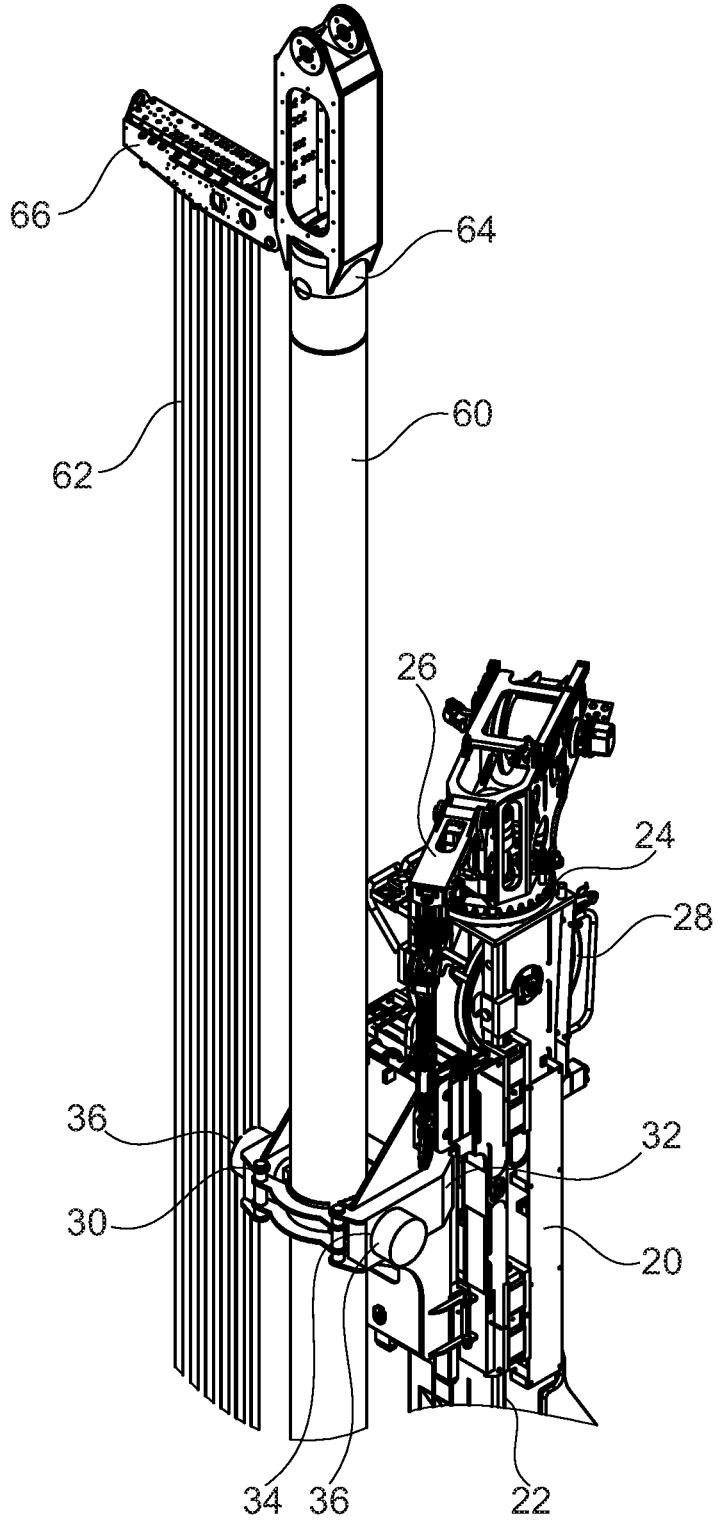
FIG. 3 an enlarged view of detail A of FIG. 2.

In the enlarged illustration of FIG. 3 the upper end region of the mast 20 and the bar-shaped holding means 60 is depicted in greater detail. At the upper end of the bar-shaped holding means 60 a connecting section 64 is arranged which can serve to lift the holding means 60 by means of a crane and which is in addition designed for the attachment of further bar elements for the axial extension of the holding means 60.

At the upper end of the mast 20 a mast head 24 with an additional hoisting means 26 is provided. Along the mast guide 22 the upper first clamping sledge 30 is displaceably or movably driven in the vertical direction or longitudinal direction of the mast 20. For driving purposes, a deflection roller 28 is provided in the region of the mast head 24 for a non-depicted drive rope which is connected on the one hand to a winch 29 on the mast 20, shown in FIG. 1, and on the other hand, after deflection by the deflection roller 28, to a first sledge base body 32 of the first clamping sledge 30.

By way of this first drive rope a pull force can be applied to the first clamping sledge 30 in order to pull the clamping sledge 30 upwards in the longitudinal direction. In a generally known manner provision is also made at the lower end of the mast 20 for a non-depicted further deflection roller of the drive means, in which case a further drive rope is guided from the winch 29 via the lower end of the mast 20 to the first clamping sledge 30 so that a pull force can thus be applied in the downward direction onto the first clamping sledge 30.

Arranged on the first clamping sledge 30 on the first sledge base body 32 thereof are two lateral, opposite-lying clamping cylinders 36 for forming a first clamping means 34. Through the first clamping means 34 a force-locked connection to the bar-shaped holding means 60 can be established so that by way of the first clamping sledge 30 the holding means 60, by being guided along the mast 20, can be moved upwards or downwards in the longitudinal direction. Alternatively or additionally, it is in this case possible to establish a form-locked connection, for example in that locking elements actuated by the clamping cylinders 36 engage in corresponding receiving parts on the holding means 60. For this, the holding means 60 can have several receiving parts at different positions.

Figure 4:
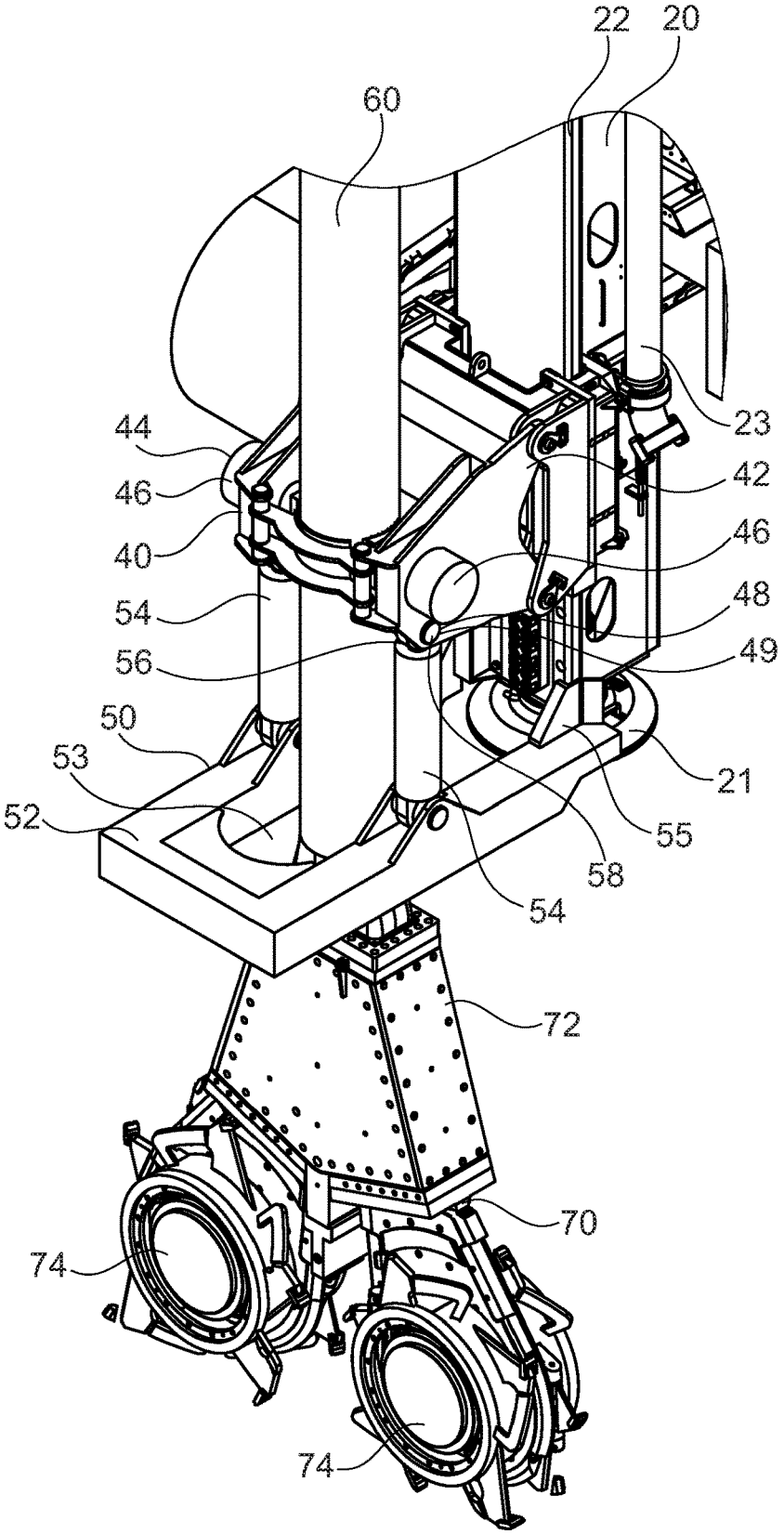
FIG. 4 an enlarged view of detail B of FIG. 2.
Figure 5:
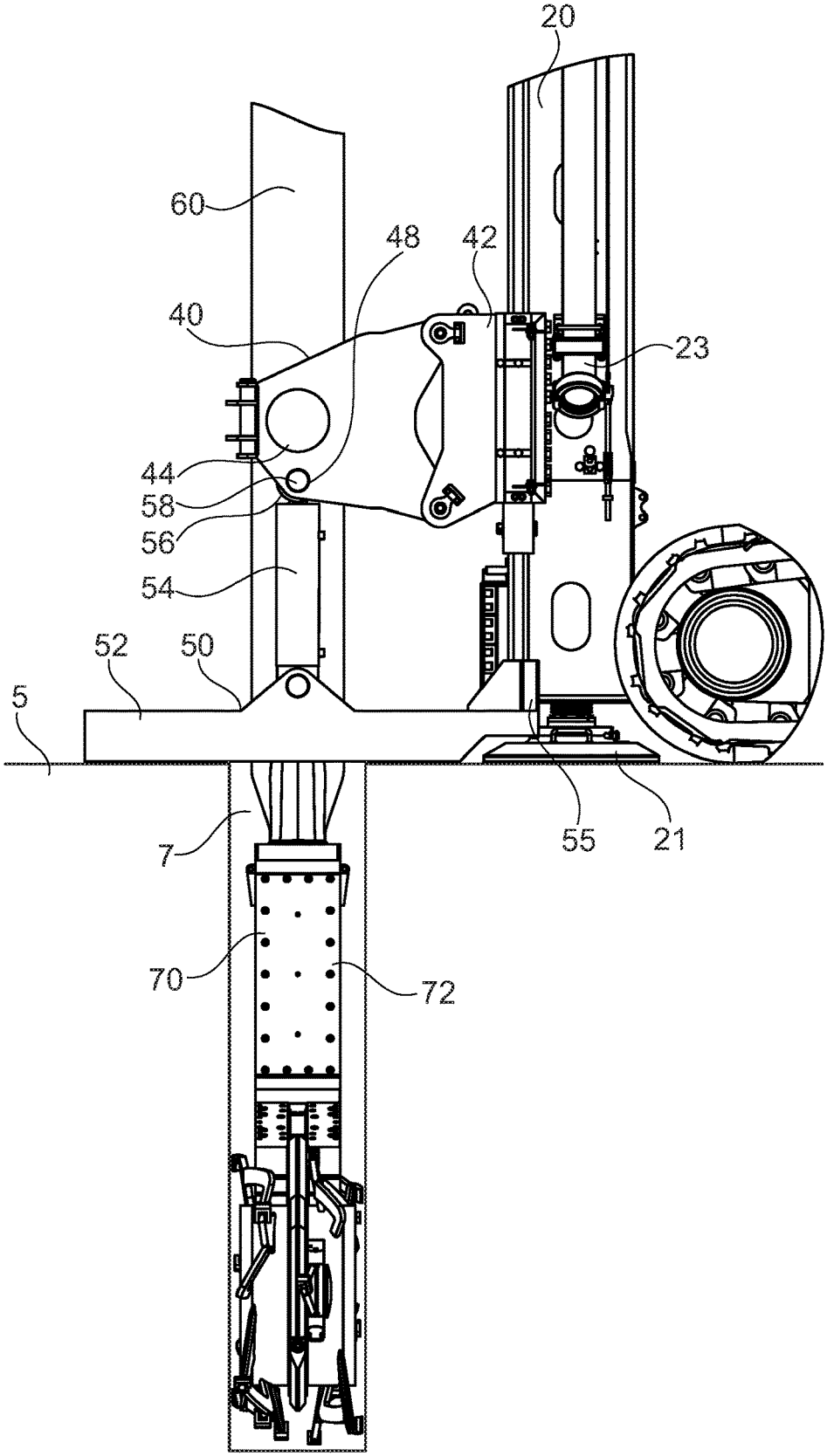
FIG. 5 a side view of detail B according to FIGS. 2 and 4.

In FIGS. 4 and 5 the region of the lower end of the mast 20 with the second clamping sledge 40 and the lifting device 50 is illustrated in greater detail. The second clamping sledge 40 is designed similar to the first clamping sledge 30 and has a second sledge base body 42 which is displaceable along the linear mast guide 22 on the mast 20. While the first clamping sledge 30 is actively driven in the illustrated exemplary embodiment, the second clamping sledge 40 is not movably driven by a drive means provided in a fixed manner on the carrier implement 12 or the mast 20. Hence, the second clamping sledge 40 basically constitutes a passively displaceable element that can be secured on the mast 20 if necessary. On the second sledge base body 42 two lateral clamping cylinders 46 are also arranged opposite each other to form a second clamping means 44 for the force-locked clamping of the bar-shaped holding means 60. In this case, too, a form-locked clamping connection is alternatively or additionally possible.

In normal operation of the foundation engineering machine 10 without installation of the additional lifting device 50 the passive second clamping sledge 40 can serve as a so-called slip-through protection during an extraction of the diaphragm wall apparatus 70 by means of the holding means 60. When extracting the diaphragm wall apparatus 70 in such a normal operation the first clamping sledge 30 is moved downwards along the mast 20 in order to be connected in a force-locked manner to the bar-shaped holding means 60 in a lower position. During such a downward movement of the first clamping sledge 30 the bar-shaped holding means 60 can be clamped and held by the lower second clamping sledge 40.

After a renewed clamping of the holding means 60 by the first clamping sledge 30 the force-locked connection between the holding means 60 and the lower second clamping sledge 40 can be released. In this state the first clamping sledge 30 with the holding means 60 clamped tight thereon can now be moved upwards to extract the diaphragm wall apparatus 70 from a trench 7 in the ground 5.

Subsequently, the second clamping means 44 of the second clamping sledge 40 can be activated again to enable a release of the first clamping sledge 30 and a renewed downward movement of the first clamping sledge 30 for the further extraction of the diaphragm wall apparatus 70.

If the pull force of the first clamping sledge 30 is no longer sufficient during this process, e.g. because the diaphragm wall apparatus 70 is jammed or stuck in the trench 7 in the ground 5 or the total weight consisting of diaphragm wall apparatus 70 and holding means 60 has increased considerably due to additionally installed bar elements, according to the invention an additional lifting device 50 can be mounted at the lower end of the mast 20 and the lower second clamping sledge 40.

The lifting device 50 has a C- or U-shaped positioning frame 52 with a central passage 53 for the bar-shaped holding means 60. Therefore, the positioning frame 52 is positioned on the ground 5. Here, the positioning frame 52 has a length that enables it to bridge the width of the formed trench 7 and rest on the ground 5 on both sides of the formed trench 7, as illustrated graphically in FIG. 5. By way of contact elements 55 an open side of the positioning frame 52 can be placed laterally against the lower end of the mast 20 without any imperative necessity for the positioning frame 52 to be firmly connected to the mast 20.

At the lower end of the mast 20 a supporting foot 21 for supporting the mast 20 on the ground 5 can be provided in a generally known manner.

In a lower region of the second clamping sledge 40 a connecting means 48 is designed which is formed in the illustrated exemplary embodiment by horizontally directed connecting lugs 59. By way of transversely directed locking bolts 58 two lifting cylinders 54 having a fixing eyelet 56 each can be fixed on the respective connecting lugs 49 of the connecting means 48. A lower end of the lifting cylinders 54 is in each case linked to the positioning frame 52 of the lifting device 50.

To apply an additional lifting force in the upward direction the lifting cylinders 54 can subsequently be extended when the second clamping sledge 40 is connected in a force-locked manner by way of the second clamping means 44 to the bar-shaped holding means 60. In this way, the second clamping sledge 40 which is displaceably supported on the mast 20 can be pressed upwards together with the holding means 60. By preference, the lifting cylinders 54 are aligned centrally to the trench 7 in the ground 5 and parallelly to the longitudinal direction of the mast 20 so that virtually no transverse force is exerted onto the carrier implement 12. Hence, through the additional lifting device 50 high lifting forces can be applied when necessary, without the tilt stability of the foundation engineering machine 10 being appreciably affected. The lifting process can be repeated stepwise.

Accordingly, when necessary an additional feed force can also be applied by the lifting device 50 in the downward direction onto the bar-shaped holding means 60 and the diaphragm wall apparatus 70. In this case, the lifting device is anchored in the ground e.g. by means of ground anchors (not shown) to prevent the positioning frame from lifting off during the application of the additional feed force. If there is no need for an additional lifting force, the lifting device 50 can be dismantled again by releasing the connecting means 48 and removed from the foundation engineering machine 10.

In the illustrated exemplary embodiment the diaphragm wall apparatus 70 is designed as a diaphragm wall cutter with an implement frame 72 and cutting wheels 74 arranged thereon. The illustrated diaphragm wall cutter is designed for a so-called CSM®-method, with the circumferential dimensions of the implement frame 72 being smaller than a cutting cross-section. Thus, the implement frame 72 is spaced from the walls of the trench 7 in the ground 5. Through this, suspension can be introduced via a supply line 23 from the foundation engineering machine 10 via a hose line, not depicted in greater detail, into the trench 7 and mixed by the cutting wheels 74 directly in-situ in the trench 7 with removed ground material. The mixture thus produced can constitute a so-called ground mortar which hardens in the trench 7 into a diaphragm wall segment.

The invention claimed is:

1. A foundation engineering machine comprising:

a substantially vertical mast, a diaphragm wall apparatus, which is displaceably supported in a longitudinal direction of the mast for producing a trench in the ground, and a bar-shaped holding means, at the lower end of which the diaphragm wall apparatus is mounted and with which the diaphragm wall apparatus is linearly displaceable along the mast, wherein on the mast an upper first clamping sledge with a first clamping means for releasably clamping the bar-shaped holding means and a lower second clamping sledge with a second clamping means for releasably clamping the bar-shaped holding means are movably supported and the first clamping sledge and the second clamping sledge are movable relative to each other, the foundation engineering machine further comprises an additional lifting device which is arranged on the ground and with which a force can be applied in the longitudinal direction onto the second clamping sledge, and the lower second clamping sledge is provided with a connecting means for mounting the additional lifting device.

2. The foundation Foundation engineering machine according to claim 1, wherein the first clamping means and the second clamping means can be actuated independently of each other by a control means for alternately clamping the bar-shaped holding means.

3. The foundation engineering machine according to claim 1, wherein the diaphragm wall apparatus is designed as a diaphragm wall cutter or as a diaphragm wall grab.

4. The foundation engineering machine according to claim 1, wherein the holding means is of greater length than the mast or formed with several bar elements.

5. The foundation engineering machine according to claim 1, wherein the bar-shaped holding means is of tubular design.

6. The foundation engineering machine according to claim 1, wherein at least the upper first clamping sledge is movably driven along the mast.

7. The foundation engineering machine according to claim 1, wherein the connecting means has at least one connecting lug directed transversely to the longitudinal direction, wherein for a releasable connection between a lifting cylinder of the lifting device and the second clamping sledge a locking bolt can be inserted through a fixing eyelet of the lifting cylinder and the at least one connecting lug.

8. A lifting device for a foundation engineering machine according to claim 1, wherein the lifting device has a lower positioning frame for positioning on the ground and at least one lifting cylinder which is fixed on the positioning frame and is provided with a connecting element for connection to a clamping sledge.

9. The lifting device according to claim 8, comprising two or more lifting cylinders which are hydraulic cylinders.

10. The lifting Lifting device according to claim 8, wherein the positioning frame is of ring-shaped or partially ring-shaped design with a central passage for a bar-shaped holding means.

11. A method for producing a trench in the ground using the foundation engineering machine according to claim 1, the method comprising providing the connecting means of the second clamping sledge with at least one connecting lug directed transversely to the longitudinal direction, wherein for a releasable connection between a lifting cylinder of the lifting device and the second clamping sledge a locking bolt can be inserted through a fixing eyelet of the lifting cylinder and the at least one connecting lug, wherein by means of the bar-shaped holding means the diaphragm wall apparatus is sunk into the ground while ground material is being removed, wherein the trench is produced, by way of at least one of the clamping sledges the bar-shaped holding means is moved along the mast, the lower second clamping sledge is releasably connected to the additional lifting device, in which is positioned on the ground, and by means of the second clamping means the second clamping sledge is clamped tight on the holding means and by way of the additional lifting device a lifting force is applied to the holding means and the diaphragm wall apparatus.

12. The method according to claim 11, wherein during sinking at least one further bar element is installed on the bar-shaped holding means for extension.

13. The method according to claim 11, wherein the trench is filled with a hardenable mass to form a diaphragm wall segment in the ground.

14. The method according to claim 13, wherein the hardenable mass is formed in-situ in the trench during the cutting.

15. The method according to claim 11, wherein the lifting force is applied by the lifting device during the extraction of the diaphragm wall apparatus from the ground.

* * * * *